United States Patent [19]

Arabian et al.

[11] Patent Number: 4,579,261

[45] Date of Patent: Apr. 1, 1986

[54] ROOM SPRAY DISPENSER

[75] Inventors: Sandro Arabian, Vaduz; Manfred Baumann, Diepoldsau; Alois L. Stahli, Balgach, all of Switzerland

[73] Assignee: CWS AG, Baar, Switzerland

[21] Appl. No.: 598,056

[22] Filed: Apr. 9, 1984

[30] Foreign Application Priority Data

Apr. 15, 1983 [CH] Switzerland ..... 2026/83

[51] Int. Cl.[4] ..... B67D 5/00

[52] U.S. Cl. ..... 222/505; 222/180; 239/274

[58] Field of Search ..... 222/180, 162, 505, 153, 222/402.11, 402.13, 402.15, 645, 649, 372; 239/274

[56] References Cited

U.S. PATENT DOCUMENTS

| | | | |
|---|---|---|---|
| 3,033,471 | 5/1962 | Horn | 239/274 |
| 3,214,062 | 10/1965 | Mahon | 222/649 |
| 3,805,732 | 4/1974 | Reed | 222/180 UX |
| 3,827,606 | 8/1974 | Knickerbocker | 222/153 X |
| 3,980,205 | 9/1976 | Smart | 222/649 |

FOREIGN PATENT DOCUMENTS

| | | | |
|---|---|---|---|
| 0738270 | 7/1966 | Canada | 222/645 |
| 1147976 | 12/1957 | France | 239/274 |
| 933555 | 8/1963 | United Kingdom | 222/162 |

*Primary Examiner*—H. Grant Skaggs
*Assistant Examiner*—Nils E. Pedersen
*Attorney, Agent, or Firm*—Murray, Whisenhunt & Ferguson

[57] ABSTRACT

The room spray dispenser (1) holds a container (29) that is provided with a valve element (27) which also works simultaneously as a pump. Above the valve element (27) the operating end (25') of a pressure lever (25) is located. It is loaded in the direction of the valve element (27) with at least one spring (26,33). The blocking lever (14) has a raised contact surface (14''). This surface is pressed downward with the operating end (3') of a swivelling lever triggering mechanism, which is mounted on the door (5) or the door frame (6). This downward movement trips the blocking lever (14), which then allows the pressure lever (25) to press down upon the upper part of the valve element (27) due to the force of the tension spring (26). By the return movement of the swivelling lever (3) the blocking lever (14) is raised upwards to its original position and cocked by means of the cocking lever (15). The tension spring (26) is also stretched during this process. The advantage of this arrangement lies in its simple construction, positive operation, uniform dispensing of the mixture of deodorizing and/or scented liquid and air, and its general applicability to various kinds of door constructions or other elements which move relatively to each other. This arrangement requires no spray cans with propellent gas.

13 Claims, 18 Drawing Figures

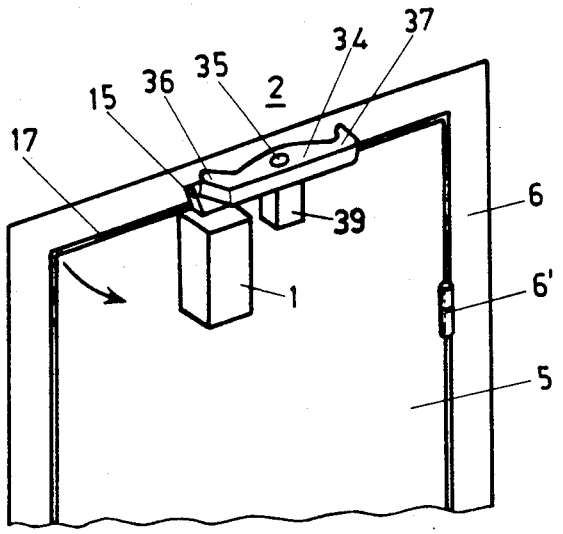
FIG. 8
FIG. 9
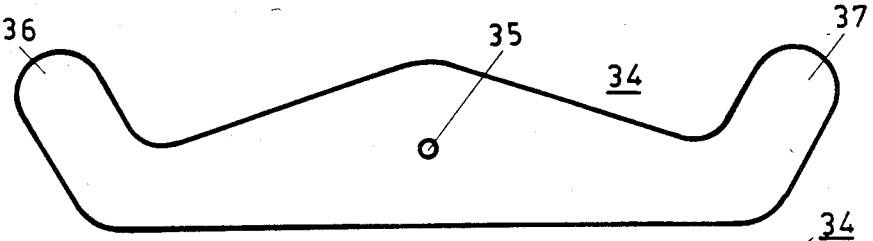
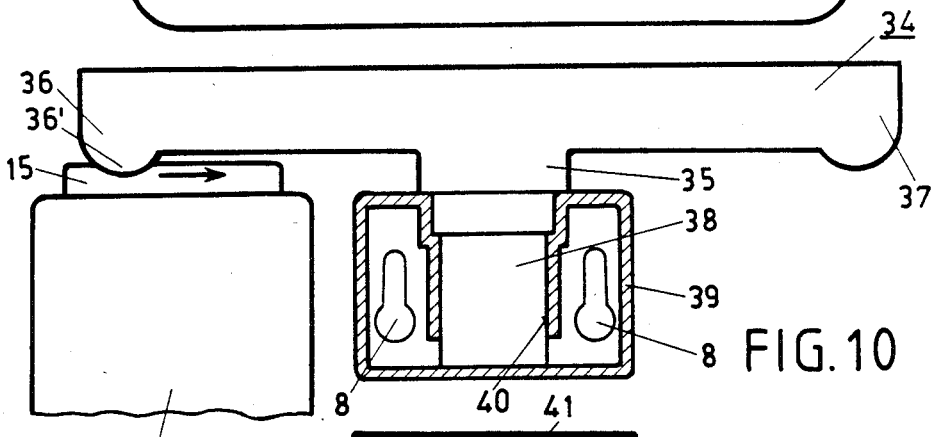
FIG. 10
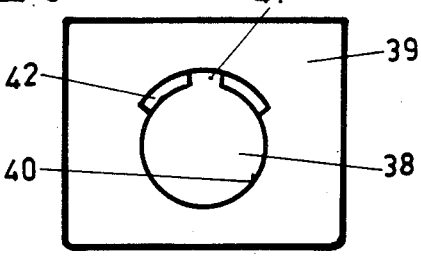
FIG. 11

ROOM SPRAY DISPENSER

FIELD OF THE INVENTION

This invention concerns a room spray dispenser with a triggering mechanism. Within the room spray dispenser a container is provided for or with a scented and/or deodorizing liquid to be atomized and the neck of the container is provided with a valve element containing a nozzle.

BACKGROUND OF THE INVENTION

This room spray dispenser is a liquid atomizing device that is fastened on or near a door, so that every time the door is used a pre-defined amount of scented and/or deodorizing liquid is atomized.

The known arrangements of this kind either operate with aerosol spray cans or with partially mechanically, partially electrically activated atomizing valves. These valves are integrated into the apparatus and operate on the basis of a piston pump.

The disadvantages of these arrangements are either in the aerosol propellent gas, which is damaging to the environment, the dependency on electrical current and/or the expensive maintainance of the atomizer which is integrated in the device.

An arrangement of the type described in the introduction is, for example, described in the French patent FR-PS No. 765.386 which holds a container filled with a disinfecting or scented liquid. The device is provided with a cylinder and corresponding piston. By means of a lever, one end of which can, for example, be mounted on the door, a notched disk is rotated. This rotation in turn puts tension on a spring. One end of the lever then engages with the notch and locks the disk, keeping the spring in the stretched position. Upon operation, the end of the lever releases the disk, the disk rotates due to the force of the spring, and a lever moves the piston in the cylinder. Thus the air is forced out of the cylinder, mixed with a part of the liquid, and sprayed out of the device. This device is relatively complex and the piston gasket must be periodically inspected. As the level of the liquid sinks in the container, the air/liquid mixing ratio is changed and thus no uniform amount of spray can be obtained.

SUMMARY OF THE INVENTION

The purpose of the present invention is to eliminate the disadvantages of the known arrangements and to create a room spray dispenser of the kind mentioned above which is simple in construction, operates reliably, and which insures a uniform dispensing of the deodorizing and/or scented liquid.

A hand-operated atomizer can only spray out a fog that is completely free of drops when the atomizing button is rapidly pressed. The invention should therefore contain a lever mechanism to transform the relatively slow motion of an opening door into an abrupt atomizing motion.

The above task is achieved by making the valve element also serve as a pump, by locating the operating end of a pressure lever above the valve element and loading it in the direction of the valve element with at least one spring, and providing the pressure lever with a cocking and blocking mechanism.

The advantage of the invention can be seen in the simple way it achieves a uniform dispensing of the liquid. This is done by the spring-loaded pressure lever, which activates the pump located inside the valve element in a very simple manner. The cocking and blocking mechanism can be constructed in such an uncomplicated way that the room spray dispenser can be made to operate when the triggering mechanism moves in one direction, but not in the other. With the help of the spring-loaded pressure lever one can achieve a sufficiently rapid motion to insure a uniform atomization of the liquid.

In a further development a tiltable blocking lever is arranged above the pressure lever and relates to a trigger element of the trigger mechanism. With the blocking lever it is simple to bring the pressure lever into the cocked position. The blocking lever is tripped with the trigger element of the trigger mechanism.

Depending on the way the room spray dispenser is mounted and on whether the door opens outwards or inwards, the trigger element can be designed as a swivelling lever, a double-armed trigger lever, or as a trigger pin.

In another embodiment, the trigger element is designed as a lever-like trigger whose lower part is rotatably supported and whose upper part is bent over and across the blocking lever.

This embodiment has the advantage that the room spray dispenser can be located farther away from the door. This is accomplished by means of a lever-like trigger which can be controlled by the movement of the door over a certain distance.

A cord attached to the upper part of the lever-like trigger is suitable to control the lever-like trigger. This cord is either connected directly to a point on the door or it is guided through at least one eyelet that is appropriately placed on the wall and/or the door.

It is expedient to provide one end of the blocking lever with sliding surfaces which relate to the cam-like projections of a tiltably supported cocking lever. With the help of these sliding surfaces the blocking lever can be brought back to the cocked position with the spring again under tension.

In one advantageous embodiment the blocking lever above the valve element is designed with an raised upper contact surface whose purpose is to initiate the operating sequences of the room spray dispenser by pressing the operating end of the trigger element of the trigger mechanism. The trigger element moves above the blocking lever, disengages the blocking lever, and upon contact with the raised upper contact surface depresses the operating end of the blocking lever through its contact with the raised contact surface.

In another embodiment the blocking lever is provided with a raised upper contact surface, located in the rear part above a compression spring, so that the front end of the blocking lever extends to the the front end of the room spray dispenser.

It is expedient if a tension spring is provided between the lower surface of the pressure lever and a pin fastened between the two supporting walls and if a compression spring is provided above the valve element between the lower surface of the blocking lever and the upper surface of the pressure lever.

In a further development the pressure lever is supported by a lever that is rotatably fixed in the lower part of the cocking lever. This construction determines the lowest position of the pressure lever and also increases the mechanical stability of the whole assembly.

DESCRIPTION OF THE DRAWINGS

The invention will now be more precisely explained in conjunction with the following drawings:

FIG. 8 shows a simplified perspective view of another embodiment in which a double-armed trigger lever is employed as the trigger element and the room spray dispenser is attached to a door that opens inwards.

FIG. 9 shows a top view of the double-armed trigger lever of FIG. 8.

FIG. 10 shows a front view with a partial cross-section through the attachment housing of the embodiment shown in FIG. 8.

FIG. 11 shows a schematic illustration of the bearing of the double-armed trigger lever of FIG. 8 in an attachment housing which is mounted on the door.

DETAILED DESCRIPTION OF THE DRAWINGS

Figure 1:
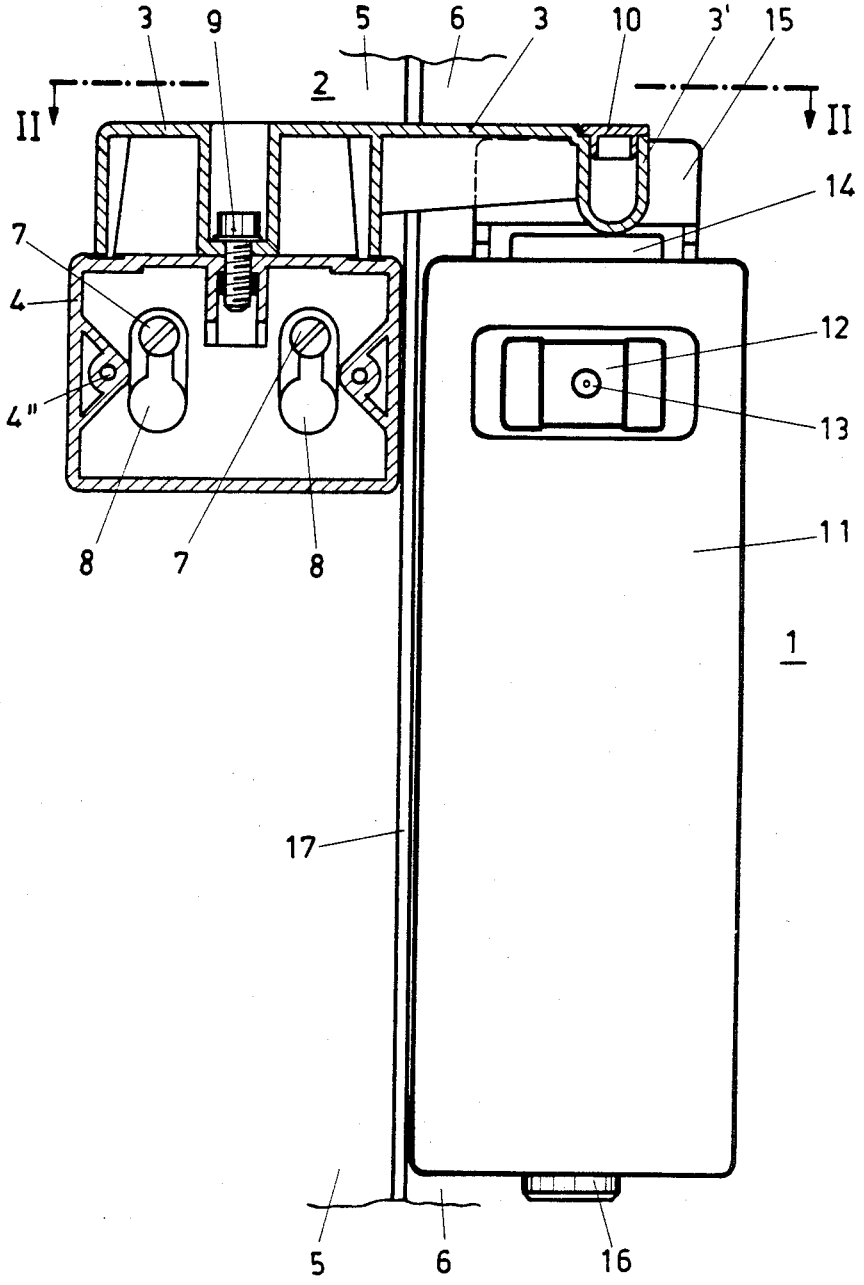
FIG. 1 shows a side view of the room spray dispenser and a trigger mechanism in which the trigger mechanism, in the form of a swivelling lever, is shown in a cut-away view.

FIG. 1 shows a room spray dispenser 1 attached to a door frame 6 and a trigger mechanism 2 attached to a door 5. In the upper part of FIG. 1 a cut-away view of a swivelling lever 3 employed as a trigger element is shown. The operating end 3' is located above the room spray dispenser 1. The swivelling lever 3 is rigidly connected to an attachment housing 4. The attachment in this case was carried out with the help of a cylindrical screw 9. The cover 4', not visible in this drawing, is held by means of fasteners 4''. The holes are visible in FIG. 1, in which two wood screws 7 are attached. The attachment housing 4 is fastened on the door 5 with the help of wood screws 7, which are guided through the recesses 8. A dust cover 10 is pushed on the operating end 3' of the swivelling lever 3. The room spray dispenser 1 is provided with a cover 11, which has an opening 12. The nozzle 13 is visible through this opening. The part of the blocking lever 14 whose surface is in contact with the operating end 3' of the swivelling lever 3 is illustrated in FIG. 1. A part of the cocking lever 15 is visible behind the operating end 3' of the swivelling lever 3. A part of a lock 16 is shown in the lower part of the cover 11. A crack between the door 5 and the door frame 6 is designated with number 17.

The same parts in all the figures are designated by the same numbers.

Figure 2:
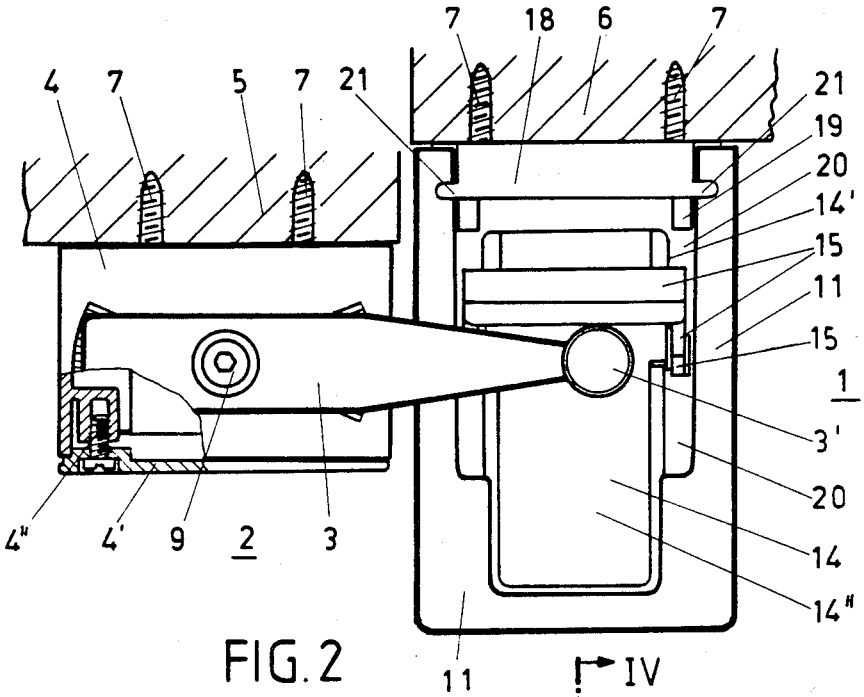
FIG. 2 is a top view of the arrangement shown in FIG. 1.

FIG. 2 shows a top view of the arrangement shown in FIG. 1. In this figure the sliding surfaces 14' of the blocking lever 14 and an upper contact surface 14'' of the blocking lever 14 are visible. A rear wall 18 is also fastened to the door frame 6 with wood screws 7. One-piece supporting walls 19 are formed with the rear wall 18, which run vertically as well as horizontally perpendicular to the rear wall 18. There is an upper recess 20 in the cover 11, through which the cocking lever 15 and the blocking lever 14 project upwards. Fastening ridges 21, formed in one piece with the rear wall 18, serve to put on and fasten the cover 11.

Figure 3:
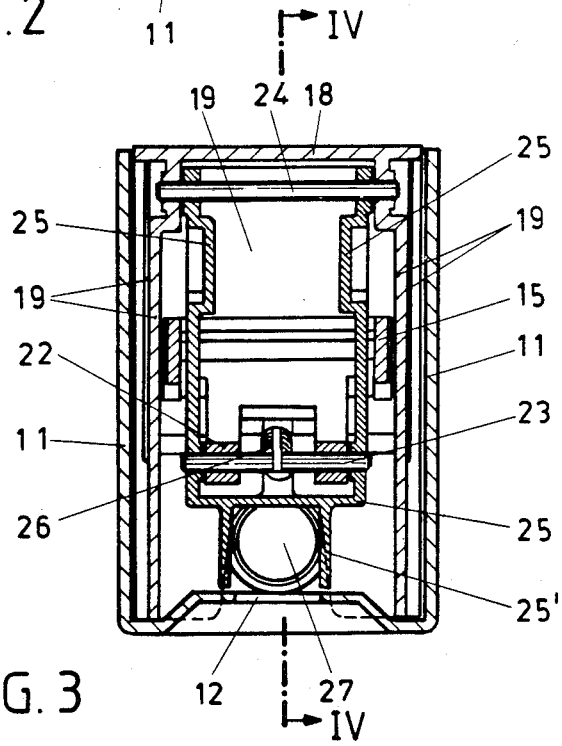
FIG. 3 shows a horizontal cut III—III through the room spray dispenser of FIGS. 1 and 2 carried out above the valve assembly.

The cut-away view of FIG. 3 shows additional parts of the room spray dispenser 1. A first pin 23 is supported in a pressure lever 25, whereas a second pin 24 is designed as a tiltable support for the pressure lever 25. Both ends of this second pin are fastened in the supporting walls 19. The operating end of the pressure lever 25 is designated with the number 25'. The end of a tension spring 26 is slipped on the first pin 23. The valve element 27 is visible in the lower part of FIG. 3.

Figure 4:
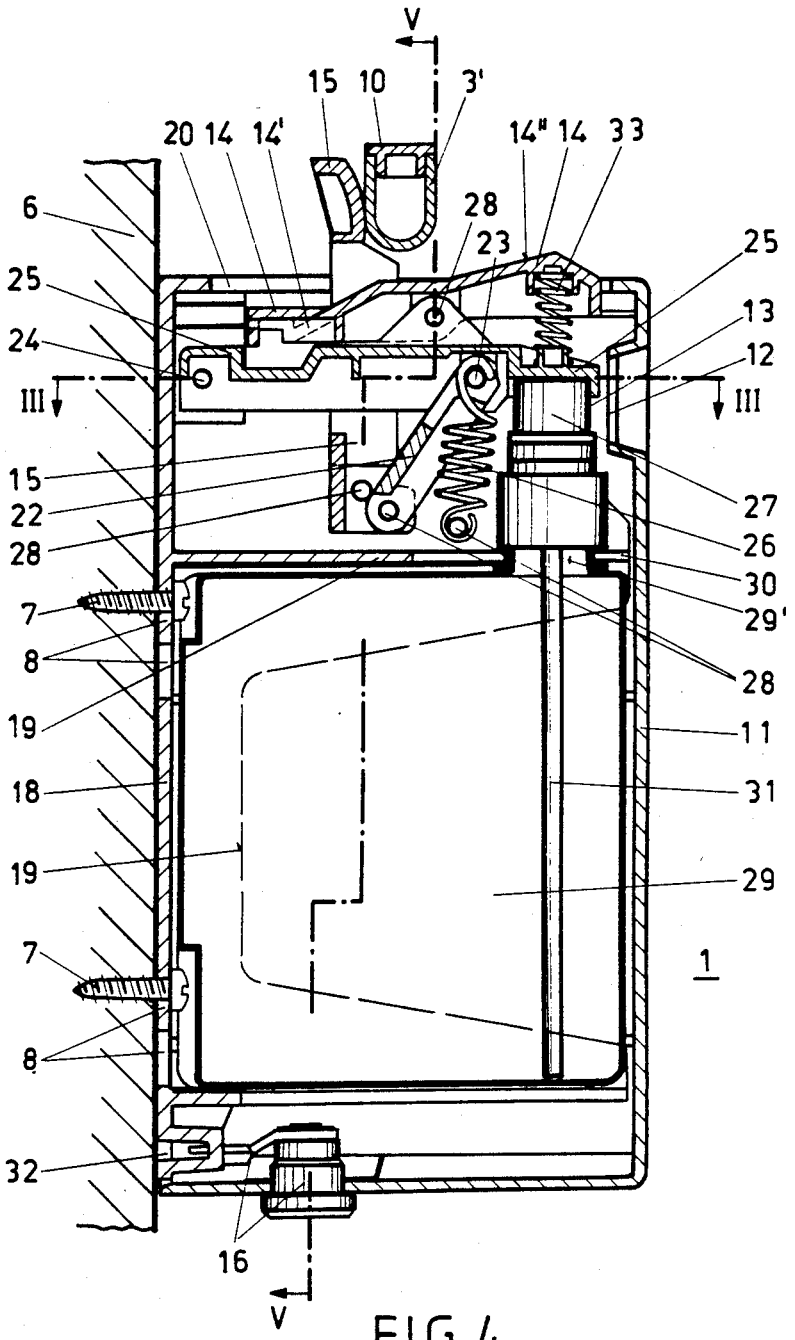
FIG. 4 shows a vertical cut IV—IV in FIG. 5 through the room spray dispenser of FIGS. 1–5 perpendicular to the rear wall.

FIG. 4 shows a vertical cut through the room spray dispenser 1 perpendicular to the rear wall 18. In addition to the parts already described, more pins 28 are visible in this drawing. One of these pins serves as a tiltable connection of the blocking lever 14 with the pressure lever 25, another for the rotatable connection of a lever 22 with the lower part of the cocking lever 15, another for the rotatable support of the cocking lever 15 in the supporting walls 19. The last pin 28 forms a holder for the lower end of the tension spring 26. A container 29 for the deodorizing and/or scented liquid is provided with a neck 29', upon which is screwed the valve element 27. The neck 29' passes through an recess 30 in the horizontally arranged supporting wall 19. A tube 31 leads from the valve element 27 to the bottom of the inside of the container 29 and is, of course, open at the end. In the lower part is an opening 32 in one piece with the rear wall 18 for the latch part of the lock 16. A compression spring 33 is positioned between the blocking lever 14 and the pressure lever 25.

Figure 5:
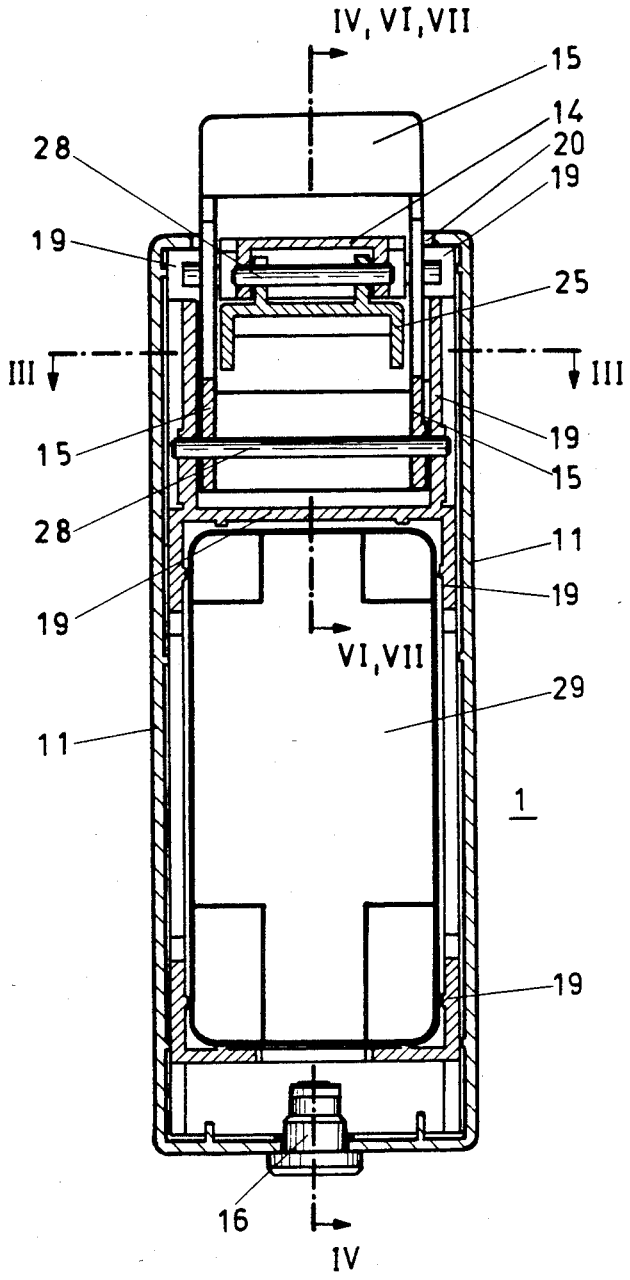
FIG. 5 shows a vertical cut V—V in FIG. 4 through the room spray dispenser of FIGS. 1–5 parallel to the rear wall.

FIG. 5 shows a vertical cut parallel to the rear wall 18 of the room spray dispenser 1. The parts illustrated in this figure have already been described in the earlier drawings.

Figure 6:
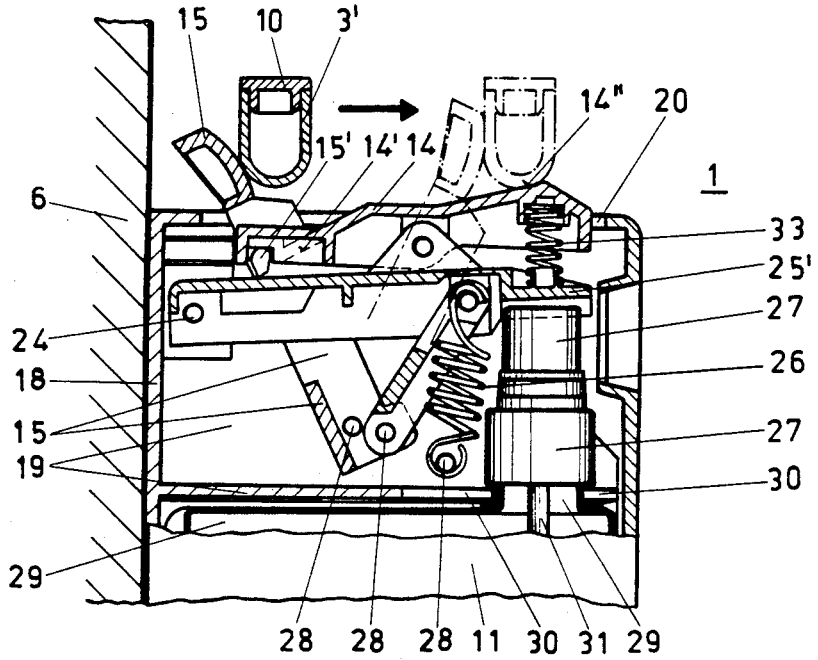
FIG. 6 shows the upper part of the vertical cut of FIG. 4 drawn with two other working positions.
Figure 7:
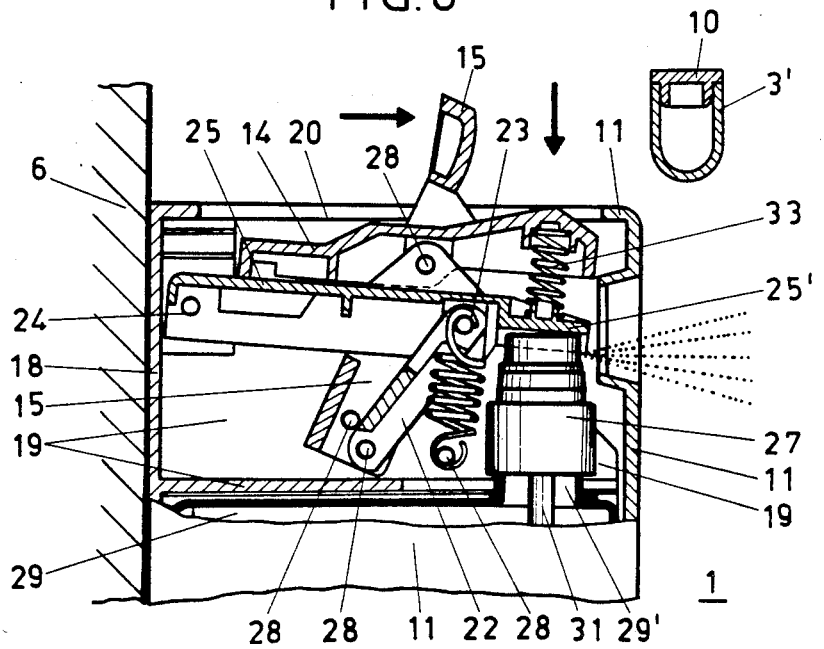
FIG. 7 shows the upper part of the vertical cut of FIG. 4 drawn in the phase where an air/liquid mixture is being sprayed out of the nozzle.

FIGS. 6 and 7 correspond to the upper part of FIG. 4 and serve to explain the method of operation of the room spray dispenser 1.

The method of operation of the room spray dispenser 1 becomes evident by comparing FIGS. 6 and 7. In FIG. 6 the position of the arrangement is fully diagrammed. The cocking lever 15 is in the back position where it contacts the blocking lever 14 by means of the cam-like projections 15'. The operating end 3' of the swivelling lever 3 is shown in the resting state which is the case when the door 5 is closed. When the door 5 is opened, the operating end 3' moves in the direction shown by the arrow until it is in the position indicated by the dotted lines. In this position it begins to touch the upper contact surface 14'' of the blocking lever 14. The blocking lever 14 is tripped. FIG. 7 shows the position where the operating end 3' of the swivelling lever 3 has already pushed down the upper contact surface 14''. In this phase the cocking lever 15 has sprung forward as a result of force exerted by the spring 26. The tension spring 26 also pulls down the operating end 25' of the pressure lever 25, where the operating end 25' presses down on the upper button-like part of the valve element 27 and a mixture of air with the liquid escapes out of the nozzle 13 as a spray. As has already been described, the valve element 27 contains not only a valve, but it also operates like a pump. Upon pressing down the upper part of the valve element 27, a certain amount of air is forced into the container 29. The pressure of this air cushion acts upon the surface of the liquid and, by means of the tube 31, a predetermined amount of deodorizing and/or scented liquid is forced into the valve element 27, where it is mixed with air and is sprayed out the nozzle 13. As the operating end 3' of the swivelling lever 3 returns to place, i.e. against the direction shown by the arrows, the cocking lever 15 is moved backwards to where, by means of the cam-like projections 15' and the sliding surfaces 14' of the blocking lever 14, it lifts up the blocking lever 14 and engages it in the final resting position. The pressure lever 25 follows the motion of the blocking lever 14 and again applies tension to the spring 26. During this return movement of the swivelling lever 3 neither the blocking lever 14 nor the pressure lever 15 are activated. The spraying process thus occurs only when the door 5 is opened.

FIG. 8 shows a simplified total view of another embodiment of the trigger mechanism 2 of the room spray dispenser 1. In this case both the room spray dispenser 1 and the attachment housing 39 for the trigger element 34 are fastened to the door 5 in the manner already described. In this example the door 5 opens inward. The trigger element 34 is constructed in the form of a double-armed trigger lever 34. The right support end 37 of the trigger lever 34 rests against the door frame 6. The left operating end 36 of the trigger lever 34 serves to activate the room spray dispenser 1, of which only the upper part of the cocking lever 15 is shown in the simplified drawing. Number 35 indicates the rotation axis of the trigger lever 34. The room spray dispenser 1 with its associated levers corresponds to the room spray dispenser 1 shown in FIGS. 1 to 5. Its operating principle is also the same as that described in conjunction with FIGS. 6 and 7.

FIG. 9 shows a top view of the trigger lever 34. In this figure the operating end 36 and the supporting end 37 are again illustrated. The circle 35 indicates the location of the rotation axis of the trigger lever 34.

The operating principle of the trigger lever 34 is evident from FIG. 10. Both ends of the trigger lever 34 are provided with projections 36'. In this example only the left projection 36' of the operating end 36 has a definite purpose, namely to activate the lever of the room spray dispenser 1, as has been described. The trigger lever 34 contains a spring (not illustrated). The purpose of this spring is to rotate the trigger lever 34 when the door 5 is opened so that the projection 36 on the trigger lever 34 presses down the contact surface 14'' of the blocking lever 14. The trigger lever 34 is symmetrically constructed so that it can be used on doors which open inward either on the left or on the right. In this example the supporting end 37 can also be used as the operating end 36 and vice-versa. A cross-section of the attachment housing 39 is drawn in FIG. 10. It is provided with a round vertical bearing 40, in which is set the pivot 38 of the trigger lever 34. The bearing 40 can either hold the pivot 38 without any play, so that it acts like a weak brake, or it can be provided with an already developed braking arrangement using a spring.

FIG. 11 schematically illustrates the bearing for the pivot 38. This pivot 38 is provided with a stop 41, which moves within an enlargement 42 of the bearing 40 during the movement of the trigger lever 34. This stop 41 prevents the trigger lever 34 from turning so far that it could get outside the range where it can function properly.

Figure 12:
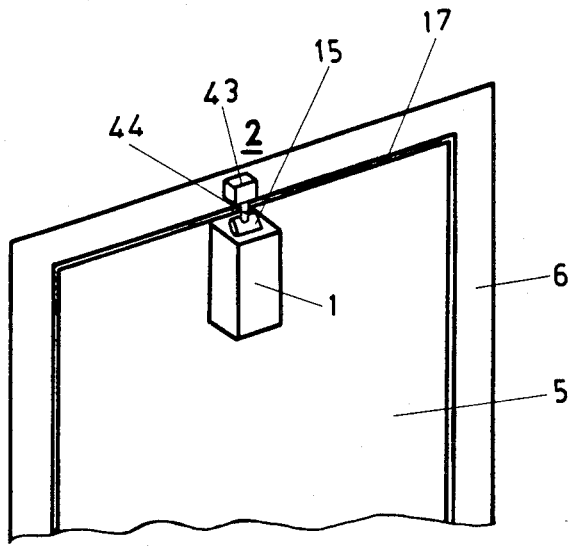
FIG. 12 shows a simplified illustration of the perspective view of another embodiment, where a trigger pin is employed as a trigger element and the room spray dispenser is attached to a door which opens outwards.

A third variation of the trigger mechanism 2 and the arrangement of the room spray dispenser 1 is schematically illustrated in FIG. 12. This variant is designed for the case where the door 5 opens outward. The room spray dispenser 1 is again the same embodiment as has been described in the first drawing. A trigger pin 44 is employed as the trigger element, which in this example is a single piece including a part of the attachment housing 43. The attachment housing 43 with the trigger pin 44 is fastened to the door frame 6, and the room spray dispenser 1 is located on the door 5. When this door 5 is opened outwards and then closed again, the trigger pin 44 contacts the lever system of the room spray dispenser 1 in the manner already described and sprays the deodorizing and/or scented liquid into the room.

Figure 13:
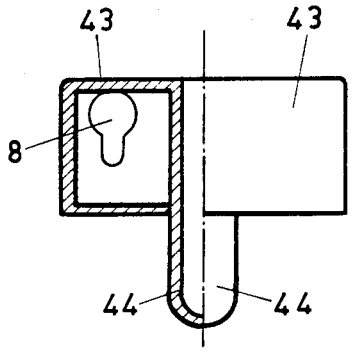
FIG. 13 shows a partial cross-section through the attachment housing and the trigger pin of FIG. 12.

FIG. 13 shows a partial cross-section of the embodiment of the attachment housing 43 depicted in FIG. 12. The left-hand side shows a recess 8 for fastening the housing 43 by means of a wood screw 7. The trigger pin 44 is hollow and the attachment housing 43 with the trigger pin 44 is injection molded from plastic.

Figure 14:
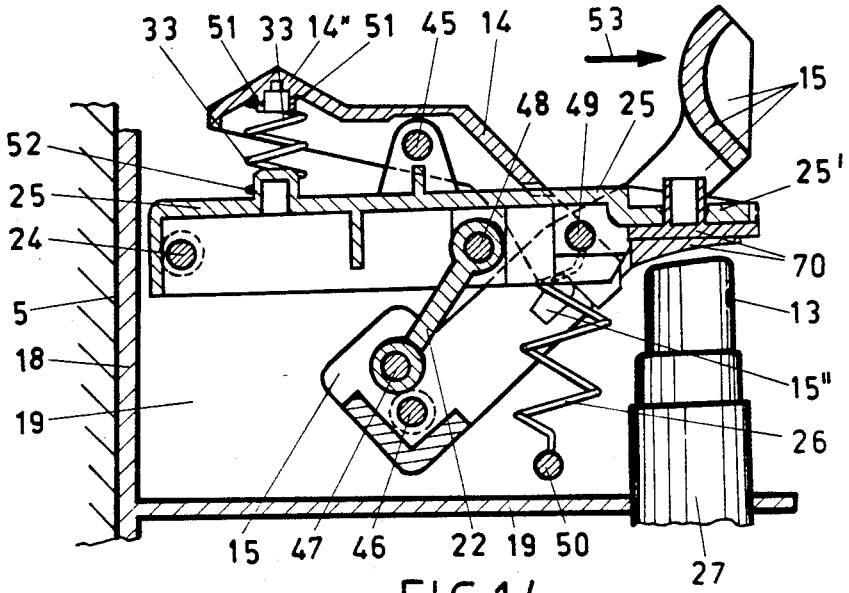
FIG. 14 shows a partially cut-away view of an embodiment of this invention where the sliding surface of the blocking lever is located in the rear part of the room spray dispenser and the room spray dispenser is in the cocked position.
Figure 15:
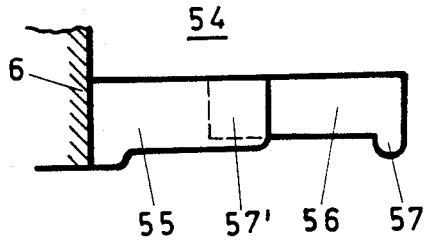
FIG. 15 shows a side view of a trigger that is suitable for the embodiment of FIG. 14.
Figure 16:
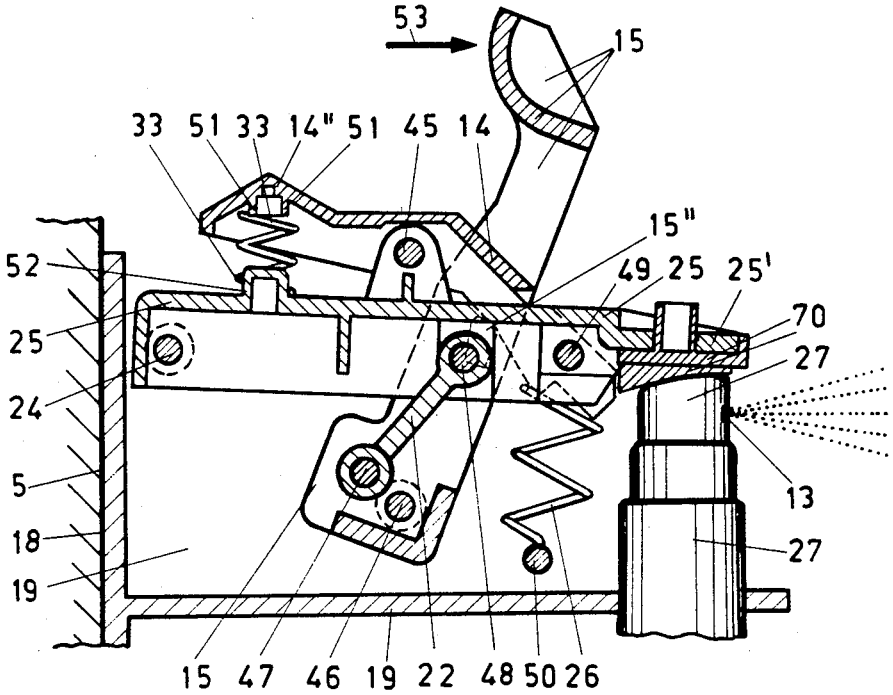
FIG. 16 shows the same embodiment of this invention as was shown in FIG. 14 except that now it is in the triggered phase during the atomization.

The embodiment shown in FIGS. 14 to 16 corresponds to that shown in FIG. 2 to FIG. 7, except that the trigger element 3 (swivelling lever) is replaced by a trigger 54 shown in FIG. 15, and the upper contact surface 14'' of the blocking lever 14 is arranged in the rear part. This makes it possible to simplify the construction somewhat. In addition to the parts already described earlier there is a pin 45 between the blocking lever 14 and the pressure lever 25 which makes feasible the recriprocal movement of these levers. Between the vertical supporting walls 19 and the cocking lever 15 a pin 46 is placed, around which the cocking lever 15 can make pivoting movements. The cocking lever 15 is provided with two locking cams 15'', with one locking cam 15'' located on the inner side of one arm and the other locking cam 15'' on the inner side of the other arm of the double-armed cocking lever 15. In FIG. 14, which illustrates the cocked state of the room spray dispenser 1, only one locking cam 15'' is shown. In this position it locks the blocking lever 14 by engaging with a recess in the blocking lever 14. When triggered, these locking cams 15'' slide over the lower surface (or surfaces, as the case may be) of the blocking lever 14, so that the cocking lever 15 also moves in the tripped position as is shown in FIG. 16. Upon being reset, these locking cams 15" force the blocking lever 14 back into the cocked position as shown in FIG. 14. In this process tension is placed on spring 26 and compression is placed on spring 33. A pin 47 is placed inside the cocking lever 15 and serves for the movable support of the lever 22, whereas an additional pin 48 is supported inside the the pressure lever 25 and guides the upper end of the lever 22. Also inside the pressure lever 25 there is a pin 49 to hold the tension spring 26. The lower end of the tension spring 26 is attached in or around another pin 50 which is fastened in the vertical supporting walls 19. A holder 51 is formed in the upper surface of the blocking lever 14 for fitting in the compression spring 33. This holder 51 is cylindrically formed so that the compression spring 33 can either be fit inside the holder 51, as is shown, or fit around the holder 51. The lower end of the compression spring 33 is put on a holder 52. This holder 52 forms a component of the pressure lever 25. An arrow 53 shows the direction of the pressure of the trigger 54 shown in FIG. 15. The trigger 54 consists of a holder 55 and a slide bar 56. These parts are held together by screws (not shown). The operating part of the trigger 54 is designated by 57. In the cocking process this operating part 57 presses on the cocking lever 15 in the direction shown by the arrow 53. When this operating part 57 moves in the opposite direction to the arrow 53 it slides over the upper contact surface 14" of the blocking lever 14 and thus initiates the spray process. The trigger 54 has been manufactured in two pieces so that its length can be adjusted. The section of the slide bar 56 inserted in the other piece is designated by reference number 57'.

Figure 17:
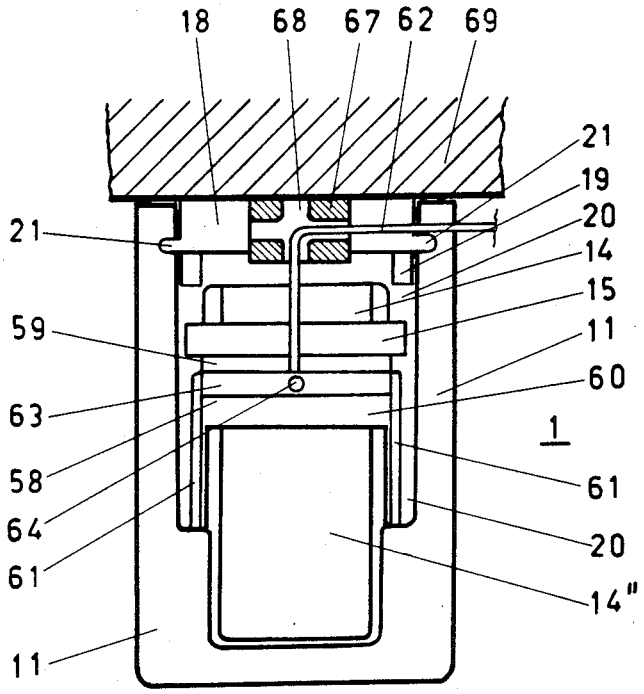
FIG. 17 shows a further development where device is triggered by a cord.
Figure 18:
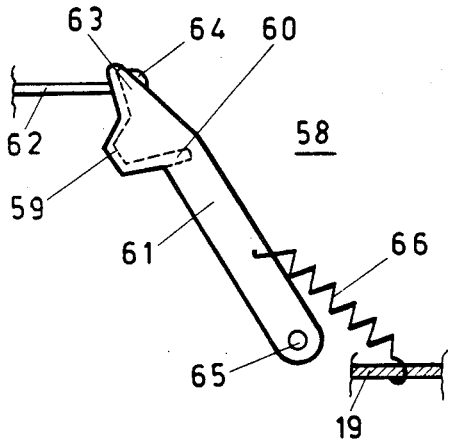
FIG. 18 shows a side view of the trigger lever of the embodiment shown in FIG. 17.

FIGS. 17 and 18 show an embodiment of this invention which employs a lever-like trigger 58 that can be pulled with a cord 62. FIG. 17 shows a top view of the room spray dispenser 1 and FIG. 18 shows a side view of the lever-like trigger 58. Number 59 designates the gripping surface of the lever-like trigger 58. This gripping surface 59 has the same function as the operating end 3' of the swivelling lever 3 shown in FIGS. 1, 2, 4 and 6, and the remaining parts of the embodiment shown in FIGS. 17 and 18 (except for the lever-like trigger 58) are the same as those in the mentioned figures. In this example the trigger 58 is accordingly a practical component of the room spray dispenser 1. The gripping surface 59 thus serves to take along the lever 15 during the cocking process. A releasing part 60 of the lever-like trigger 58 is designed to contact with the cocking lever 15. The side pieces 61 of the lever-like trigger 58 are rotatably supported between the vertical supporting walls 19 with a pin 65. The cord 62 is fastened to an attachment part 63 of the lever-like trigger 58 by means of an attachment 64 made of metal or some other material. The cord 62 is best made from a smooth, flexible plastic and it is designed to cock the room spray dispenser 1. Each of the side pieces 61 of the lever-like trigger 58 are prestressed in a forward direction with a tension spring 66, so that pulling the cord 62 stretches the tension spring 66 and prepares it for the next spraying process. However when the cord 62 is loose, the two tension springs 66 move the side pieces 61 of the lever-like trigger 58 forward, so that the lever-like trigger 58 initiates the next spray process. The operating end 25' of the pressure lever 25 is provided with a pressure button 70 (FIG. 16) whose lower surface is adapted to fit into the upper surface of the valve element 27.

If it is not possible to guide the cord 62 in a straight line, it is expedient to use at-least one eyelet 67 which is shown in cross-section in the upper part of FIG. 17 above the room spray dispenser 1. In this example the eyelet 67 is shaped like a prism and has holes 68 that cross each other so that the eyelet 67 can be used to change the direction of the cord 62 in practically any way. With this embodiment the room spray dispenser 1 can be located on a wall 69 that is relatively far away from the door 5 and nevertheless be operated simply, for example, by means of the cord 62.

The room spray dispenser as well as the trigger mechanism can be manufactured cheaply from plastic using already known technological processes. The construction is especially advantageous since the pulse-like operation of the pump produces a spray stream that has a long range, fine distribution and uniform density without having to resort to any propellent gas. The arrangement is especially useful for toilet stalls and can guarantee a reliable elimination or supression of odors.

As is evident from the examples described, the room spray dispenser can be fastened on the door, on the door frame and also relatively far from the door, providing, of course, that the appropriate kind of trigger element 3, 34, 44, 54, 58 is used. These variations of the trigger mechanism 2 make possible the use of any of the structural parts already given whose operation should bring the room spray dispenser 1 in operation.

What is claimed is:

1. A room spray dispenser, comprising:

container means for containing a scented and/or deodorizing liquid to be atomized, said container means having a neck, said neck including a valve means and a nozzle means, said valve means for controlling discharge of and pumping said liquid out of said container means through said nozzle means, said nozzle means for atomizing liquid pump through said nozzle means and for discharging atomized liquid into a room;

a pressure lever having an operating end located above said valve means, said pressure lever being spring biased in the direction of said valve means;

a triggering mechanism operatively associated with said pressure lever, said triggering mechanism including a blocking lever and a trigger element, said blocking lever being tiltably arranged above said pressure lever, said trigger element being in operative relationship to said blocking lever, said trigger element being a lever-like trigger having a lower part and an upper part, said lower part being rotatably supported, and said upper part being bent over and across said blocking lever.

2. A dispenser according to claim 1, wherein a cord is fastened to said upper part of said lever-like trigger.

3. A dispenser according to claim 2, wherein said cord is guided through at least one eyelet fastened to a wall and/or a door.

4. A room spray dispenser, comprising:

container means for containing a scented and/or deodorizing liquid to be atomized, said container means including a neck, said neck having a valve means and a nozzle means, said valve means for controlling discharge of and pumping said liquid out of said container means through said nozzle means, said nozzle means for atomizing liquid pumped to said nozzle means and for discharging atomized liquid into a room;

a pressure lever having an operating end located above said valve means, said pressure lever being spring biased in the direction of said valve means;

a triggering mechanism operatively associated with said pressure lever, said triggering mechanism including a blocking lever and a trigger element, said blocking lever being tiltably arranged above said pressure lever, said trigger element being in operative relationship to said blocking lever, said triggering mechanism further including a tiltably supported cocking lever and cam-like projections located on said cocking lever, said blocking lever including sliding surfaces on said blocking lever, said sliding surfaces being in operative relationship to said cam-like projections. said blocking lever including a raised contacting surface above said valve means, said raised contacting surface being in operative relationship with said trigger element to press against said trigger element to initiate an operating sequence of the room spray dispenser.

5. A dispenser according to claim 4, including a a fixed pin and a tension spring provided between said pin and a lower surface of said pressure lever.

6. A dispenser according to claim 4, wherein a compression spring is located above said valve means between a lower surface of said blocking lever and an upper surface of said pressure lever.

7. A dispenser according to claim 6, including a lever rotatably supported in a lower part of said cocking lever and supporting said pressure lever.

8. A dispenser according to claim 4, wherein said raised contacting surface is provided in a rear part of said blocking lever, and a compression spring is located below said rear part of said blocking lever, a front end of the blocking lever extending to a side of said dispenser from which atomized liquid is discharged.

9. A dispenser according to claim 8, including a fixed pin and a tension spring provided between said pin and lower surface of said pressure lever.

10. A dispenser according to claim 8, wherein a compression spring is located above said valve means between a lower surface of said blocking lever and an upper surface of said pressure lever.

11. A dispenser according to claim 10, including a lever rotatably supported in a lower part of said cocking lever and supporting said pressure lever.

12. A spray dispenser for dispensing a spray or a liquid upon relative movement of a first surface and a second surface, said dispenser comprising:

a container for containing said liquid mounted on said first surface, said container having a neck;

valve means in said container neck for controlling and pumping liquid out of said container through said neck;

nozzle means associated with said valve means for discharging liquid pumped through said neck to the surroundings;

trigger means operably connected to said second surface for controlling operation of said valve means in response to said relative movement by transforming relatively slow relative motion of said first and second surfaces into an abrupt atomizing motion, said trigger means comprising pressure lever means associated above and biased toward said valve means for operating said valve means, cocking means for cocking said pressure lever means, and blocking means for blocking operation of said pressure lever means when said relative motion is in a given direction, and permitting operation of said pressure lever means when said relative motion is in the opposite direction, said trigger means further including a trigger lever having an upper part and a lower part, said lower part being rotatably supported and said upper part being bent over and across said blocking means, and flexible cord means for controlling said trigger lever upon said relative movement, said flexible cord means being attached at one end to said upper part and at the other end to said second surface.

13. A spray dispenser for dispensing a spray or a liquid upon relative movement of a first and a second surface, said dispenser comprising:

a container for containing said liquid mounted on said first surface, said container having a neck;

valve means in said container neck for controlling and pumping liquid out of said container through said neck;

nozzle means associated with said valve means for discharging liquid pumped through said neck to the surroundings;

trigger means operably connected to said second surface for controlling operation of said valve means in response to said relative movement by transforming relatively slow relative motion of said first and secon surfaces into an abrupt atomizing motion, said trigger means comprising pressure lever means associated above and biased toward said valve means for operating said valve means, cocking means for cocking said pressure lever means, and blocking means for blocking operation of said pressure lever means when said relative motion is in a given direction, and permitting operation of said pressure lever means when said relative motion is in the opposite direction, said blocking means including a blocking lever and a sliding surface, said cocking means including a cocking lever, a cam member located on said cocking means, said sliding surface and said cam member cooperating for causing said blocking lever to move into a cocked position upon movement of said cocking lever.

* * * * *